US005829991A

United States Patent [19]

Murphy et al.

[11] Patent Number: 5,829,991

[45] Date of Patent: Nov. 3, 1998

[54] GROUNDING BRIDGE FOR SHIELDED INTERCONNECT CABLES AND INTERCONNECT CABLES INCORPORATING SAME

[75] Inventors: Paul Murphy, Naperville; Michael O'Sullivan, Willowbrook, both of Ill.

[73] Assignee: Molex Incorporated, Lisle, Ill.

[21] Appl. No.: 609,667

[22] Filed: Mar. 1, 1996

[51] Int. Cl.[6] ..... H01R 4/66

[52] U.S. Cl. ..... 439/98; 439/610

[58] Field of Search ..... 439/98, 99, 100, 439/607, 609, 610

[56] References Cited

U.S. PATENT DOCUMENTS

| | | | |
|---|---|---|---|
| 4,502,743 | 3/1985 | Ziegler | 439/98 |
| 4,615,578 | 10/1986 | Stadler et al. | 339/143 R |
| 4,813,888 | 3/1989 | Tokizane et al. | 429/583 |
| 4,993,968 | 2/1991 | Guletsky et al. | 439/492 |
| 5,025,554 | 6/1991 | Dohi | 29/860 |
| 5,061,827 | 10/1991 | Grabbe | 174/756 |
| 5,184,965 | 2/1993 | Myschik et al. | 439/578 |
| 5,190,473 | 3/1993 | Mroczkowski et al. | 439/580 |
| 5,222,898 | 6/1993 | Fedder et al. | 439/101 |
| 5,267,868 | 12/1993 | Wolff, Jr. | 439/95 |
| 5,415,568 | 5/1995 | Kinoshita | 439/98 |
| 5,495,075 | 2/1996 | Jonckheere et al. | 174/74 R |
| 5,509,827 | 4/1996 | Huppenthal et al. | 439/638 |

FOREIGN PATENT DOCUMENTS

| | | | |
|---|---|---|---|
| 2 718 299 | 10/1995 | France | H02G 3/22 |

*Primary Examiner*—Khiem Nguyen
*Assistant Examiner*—Eugene G. Byrd
*Attorney, Agent, or Firm*—Charles S. Cohen

[57] ABSTRACT

A grounding bridge for terminating the ground portions of an interconnect cable includes a conductive metal member having two leg portions extending at angles to each other. One leg portion is folded upon itself to define a partial enclosure which receives an internal coaxial cable of the interconnect cable therein along with a jumper wire while the other leg portion is offset from the one leg portion to lie flat against the metal shielding of the interconnect cable.

16 Claims, 4 Drawing Sheets

GROUNDING BRIDGE FOR SHIELDED INTERCONNECT CABLES AND INTERCONNECT CABLES INCORPORATING SAME

BACKGROUND OF THE INVENTION

The present invention relates generally to shielded electrical cables which are used for interconnecting electronic components together, such as computers and peripheral devices, and more particularly, to interconnect cables having an improved construction which facilitates termination of the ground portion of such cables and incorporates a grounding bridge which increases the efficiency at which the cables may be terminated.

Interconnect cables are widely used in the computer field to interconnect various computer components together. Most notably, interconnect cables are used to connect computer central processing units ("CPU") to peripheral devices, such as, for example, a monitor, a printer or a CD-ROM drive. These interconnect cables must transmit a plurality of different high-frequency electromagnetic signals between interconnected components of the above-described devices, and therefore, interconnect cables include a plurality of internal wires. Such high-frequency signals of these wires are highly susceptible to interference from other electromagnetic devices in operation nearby as well as interference from adjacent signals themselves.

In order to reduce such interference, some of the internal wires of the interconnect cables are themselves formed as smaller coaxial cables with metal shielding layers extending virtually the entire length of the wires. These coaxial wires and other, unshielded wires are wrapped in an insulative layer which has a metal shielding layer braided around its exterior surface which extends the length of the interconnect cable.

The interconnect cable is terminated at its opposing ends to two connectors which may take the form of plug connectors or other style-connectors, dependent upon the type of signals the interconnect cable is designed to transmit. One type of interconnect cable known in the art is used to interconnect a CPU with a VGA or SVGA monitor. In this type of construction, the audio and video signals are carried by an interconnect cable which has two opposing ends terminated to standard male plug-type connectors. An example of such a cable construction is illustrated in U.S. Pat. No. 5,358,428, issued Oct. 25, 1994 to the assignee of the present invention and entitled "Shielded Electrical Connector." For providing an interconnection between a CPU and a high-performance video monitor, one may need to use additional video cables with an interconnect cable having VGA/SVGA connectors. The metal shielding of the interconnect cable and its internal coaxial wires provide groundpaths for the interconnect cable which are terminated to the connectors at the opposite ends of the interconnect cable.

A new standard for connectors for interconnect cables is presently being adopted by the electronics industry and is known as the "EVC" standard which stands for "Enhanced Video Connector." Interconnect cables which incorporate EVC standard connectors therein are designed so as to reduce the number of audio and video I/O cables used for interconnecting a CPU to a video monitor. The EVC standard is an improved standard for audio-visual CPU connections. In order to take advantage of this new standard, electronic manufacturers are already beginning to produce interconnect cables with connectors that meet the EVC standard. In some of these interconnect cables, which adapt an existing VGA or SVGA system to EVC capability, one end of the interconnect cable remains terminated to a conventional VGA or SVGA multiple-pin connector while the other end is terminated to a connector complying with the EVC standard.

The termination of the VGA/SVGA end of interconnect cables, especially in the "EVC adaptor" style interconnect cables referred to above, has proven to be time consuming in that the metal shielding which provides the groundpaths for the interconnect cable is presently terminated between the interconnect cable and the VGA/SVGA connector largely by hand. The most time consuming part of this assembly procedure is in the grounding of the shields of the interconnect cable and the internal coaxial conductors. These shields are woven or braided from a plurality of metal strands.

In the termination of a VGA/SVGA connector to an interconnect cable, the coaxial shielding of the internal coaxial wires (three such coaxial wires being used in a typical interconnect cable) of the interconnect cable is unwoven and peeled back for each such wire to form three separate grounding braids, a single braid being associated with each one of the three internal coaxial wires. The outer shielding of the interconnect cable is also unwoven and peeled back, and subsequently formed into three, separate grounding braid portions of the interconnect cable. Each portion of the grounding braid of the interconnector cable is then combined with the grounding braid of one of the internal coaxial cables by twisting together to form three combined grounding braids, or shielding wire "pigtails."

Three separate jumper wires are selected and individually attached to the three wire pigtails so that one jumper wire is associated with each pigtail. The junction of the jumper wire with the pigtail is soldered to electrically and mechanically interconnect the jumper wire and its associated wire pigtail. Heat-shrink style tubing may be placed over the junction and heated to reinforce the junction of the wire pigtail and jumper wire and to prevent shorting.

This manual process of effecting the termination of the ground returns of the interconnect cable is tedious and time-consuming because it requires a great deal of manual labor to unwind the shielding braids of the cable and its internal coaxial wires, separate them into three sets of pairs of wire braids and then twist them together. Additionally, this type of process lends itself to comprising the performance of the interconnect cable and its end connectors.

For example, if each of the wire pigtails are crimped together with the jumper wires during this termination process, the possibility exists that the inner dielectric of the internal coaxial wires may be damaged which may detrimentally affect the performance of the conductor, as well as the performance of the interconnect cable. Additionally, during the soldering phase of this termination, the likelihood exists that the soldering iron may contact the inner dielectric layers of the coaxial conductors of the interconnect cable and impart some heat damage to them.

The present invention is directed to an improved interconnect cable which incorporates a unique grounding bridge which provides not only a soldering platform which protects the inner dielectric layers for detrimental contact with the soldering iron, but also provides a means to reliable connect the metal shielding of the cable with its shield inner conductors and jumper wires in a manner which is believed to substantially reduce the need for tedious manual labor and greatly increases the efficiency with which the termination of such interconnect cables may be effected.

SUMMARY OF THE INVENTION

Accordingly, it is a general object of the present invention to provide a new and improved shielded, electrical multiple conductor interconnection cable assembly.

Another object of the present invention is provide a method for reliably terminating a multiple conductor interconnecting cable to a VGA connector which reduces the amount of manual labor involved in effecting the termination and which substantially reduces the likelihood of damage to the internal conductors of the interconnect cable.

A further object of the present invention is to provide a grounding bridge for providing a platform which engages the coaxial braids of the interconnect cable, its internal coaxial wires and associated jumper wires, such grounding bridge substantially surrounding the wire braids but permitting access thereto by a soldering iron.

A still further object of the present invention is to provide a grounding bridge for shielded interconnect cables which substantially reduces the labor involved in terminating the cable to a connector and reduces the likelihood of damages to the internal wires of the cable during termination, the grounding bridge including two leg portions extending angularly from each other, one leg portion being folded upon itself to define a cable conductor shielding contact area and the other leg portion extending away from the one leg portion and defining an interconnect cable shielding contact area, each of the contact areas having a solder-receiving opening disposed therein. The leg portions are in proximity to the openings to provide a heat application surface which may be contacted by a soldering iron and the openings thereof providing points of application for molten solder to flow to establish a secure and reliable connection between the grounding bridge and the shielding braids of either the interconnect cable or the coaxial internal wires thereof, without the need for unraveling or unbraiding the shielding braids of the cable and its internal coaxial wires.

Yet another object of the present invention is to provide a multiple-conductor interconnect cable in which the metal shielding of the cable and its internal coaxial conductors are terminated to grounding terminals of the cable connectors by way of grounding bridges which have opposing ends that respectively contact the metal shielding of the cable and the metal shielding of the internal coaxial wires held by the cable. The grounding bridge has at least one partial enclosure formed at one of its opposing ends and the enclosure encompasses the metal shielding of an internal coaxial conductor of the cable and a jumper wire which extends to a grounding terminal pin.

In the preferred embodiment of the invention, an interconnect cable includes an outer insulative layer, an internal metal shielding braid extending for its length lying upon a dielectric internal layer which defines a central core. The central core contains multiple wires, some of which are single lead conductors wrapped in their own insulation and others are relatively small coaxial cables with inner conductors wrapped in their own insulation layer with a metal shielding layer extending for their length. Grounding bridges having two leg portions are used to join the metal shielding of the cable with the metal shielding of the inner coaxial cables as well as with separate jumper wires. One of the leg portions provides a partial enclosure which receives one end of the jumper wire and an end of one of the inner coaxial cables with the metal shielding layer exposed thereupon and holds them together in place for soldering, while the other leg portion of the grounding bridge provides an engagement end which engages an exposed portion of the cable metal shielding braid and presents the braid in a position for soldering.

In further accordance with the preferred embodiment, the grounding bridge has two openings formed within each of its leg portions, which openings provide an entryway for molten solder to flow onto the shielding braids and/or jumper wires positioned at the leg portions. The leg portions of the grounding bridge which surround these openings provide a contact surface for the soldering iron so that the likelihood of the soldering iron directly contacting the inner dielectric layer of the inner coaxial cables is substantially reduced, if not altogether eliminated.

In accordance with the principles of the present invention, the partial enclosure of one of the leg portions may be formed in a manner such that it receives the outer metal shielding of one of the internal coaxial cables of the main cable and a conductor of a jumper wire therein. The enclosure has an opening which exposes the shielding and jumper wire conductor to the flow of molten solder during assembly.

These and other objects, features and advantages of the present invention will be apparent through a reading of the following detailed description, taken in conjunction with accompanying drawings, wherein like reference numerals refer to like parts.

BRIEF DESCRIPTION OF THE DRAWINGS

In the course of the description, reference will be made to the attached drawings in which.

DETAILED DESCRIPTION OF THE INVENTION

Figure 1:
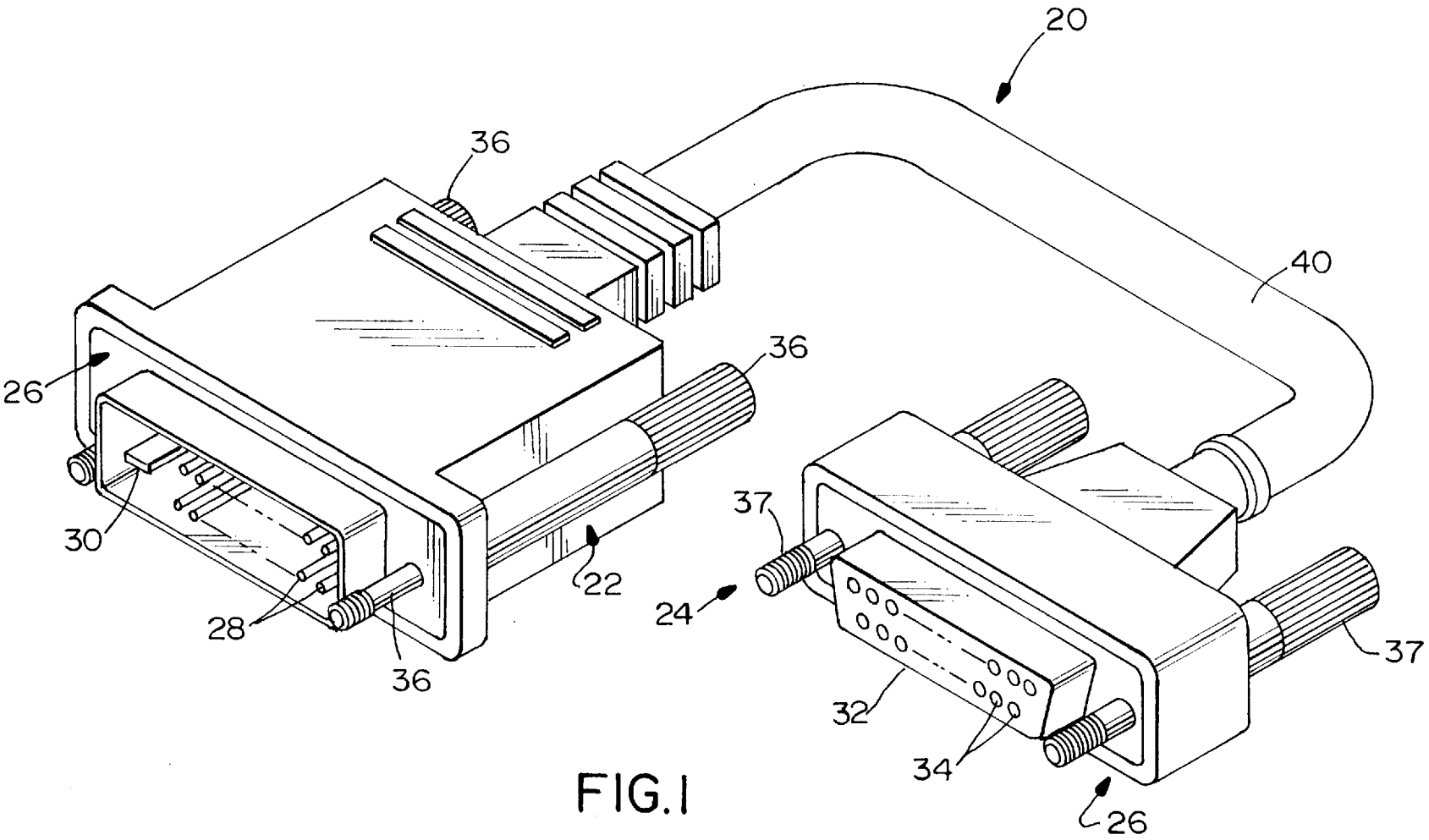
FIG. 1 is a perspective view of an interconnect cable having a EVC connector on one end and a SVGA/VGA connector terminated to its other end upon which cable is exemplary of the type of interconnect cables upon which the present invention is utilized.

FIG. 1 illustrates an interconnect cable 20 having a length of cable 21 terminated at its opposing ends to connectors 22, 24. Connector 22 is illustrated as a EVC-standard connector having a male plug end portion 26 with a plurality of contact pins 28 and a contact blade 30. The entire plug end portion 26 is encircled by an end shield 32. The other connector 24 is illustrated as a VGA/SVGA standard connector having a female plug end portion 26 with an endface 32 with a plurality of female contacts 34 therein. Both connectors 22, 24 have retention screws 36, 37 as illustrated which maintain the connectors 22, 24 in place between electronic devices, such as CPU and video monitors or the like.

Figure 2:
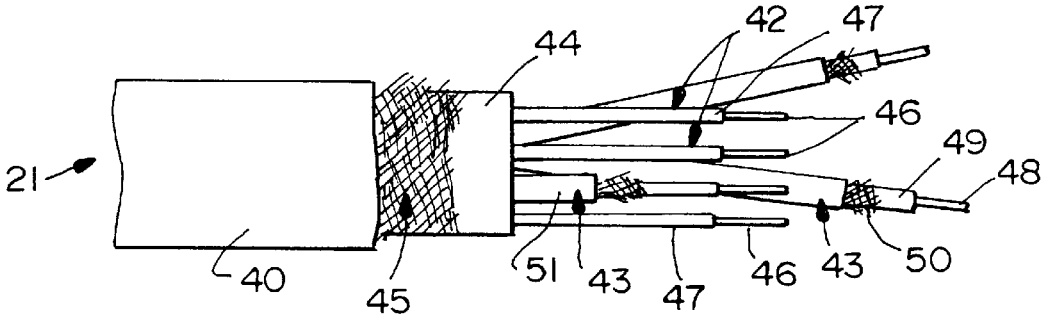
FIG. 2 is an enlarged view of the center portion of the interconnect cable of FIG. 1, nearest the right-hand connector, illustrating the respective layers and the internal conductors carried by the cable of FIG. 1.

Turning now to FIG. 2, the construction of the cable 20 will now be described in detail. The length of cable 21 includes an exterior flexible insulative covering 40 which encloses a central core of multiple wires 42, 43. The central core is defined by a Mylar® foil shield or sheath 44 which has a braided metal shielding layer 45 extending for the length of the cable 21 and encircling the sheath 44.

The central core includes multiple wires 42, 43 which are terminated to different terminals pins on the opposing connectors 22, 24. These multiple wires may include single conductor wires, as indicated at 42 and coaxial cables as indicated at 43. The single conductor wires 42 each have a central conductor or lead 46 which is surrounded by an outer insulation layer 47. The coaxial cables 43 include a central conductor or lead 48 surrounded by an inner dielectric layer 49 and a metal braided shielding layer 50 which surrounds the dielectric layer 49. The metal braiding 50 extends for the length of the coaxial cables 43 and is enclosed by an outer layer of insulation 51.

Figure 3:
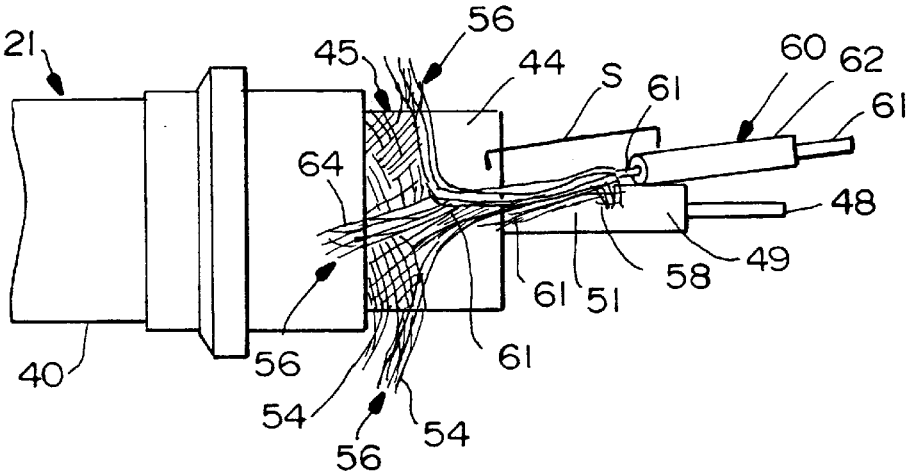
FIG.3 (PRIOR ART)
FIG. 3 is an enlarged view of the VGA/SVGA end of an interconnect cable illustrating how one known termination of such a cable is presently effected.

Presently, the termination of interconnect cables at the SVGA/VGA ends is very tedious and labor-intensive. This manner of formation is illustrated in FIG. 3. The construction illustrated in FIG. 3 shows the assembly of ground leads to the metal shielding of both the cable itself and the internal coaxial cables 43 it carries, the ground leads of this combination being effected by individual jumper wires 60. It can be seen that the outer insulation layer 44 of the cable 21 is trimmed to expose the metal shielding 45 of the cable. The metal shielding 45 is formed of a metal braid that consists of a series of individual metal strands 54.

The strands 54 of the shielding 45 are unwoven and are typically combined into a number of distinct groups of wire strands to form leads 56, three such leads 56 being illustrated in FIG. 3. The number of leads 56 so formed matches the number of internal coaxial cables 43 held by the cable central core. Next, the outer insulation layer 51 of each coaxial cables 43 is stripped and the metal shielding 50 of each cable 43 is unraveled, moved away from inner dielectric layer 49 and twisted together with one of the leads 56 formed from the cable metal shielding 45.

As mentioned above, an individual jumper wire 60 is secured to the combination of leads 56 and shield 50. The jumper wires 60 include a central conductor 61 surrounded by an outer insulation layer 62. The ends of each jumper wire are stripped to expose the central connector, and one end thereof (that shown to the left of the wire 60 in FIG. 3) is intertwined with the strands of the shielding wire leads of both the outer cable shielding 45 and the inner coaxial cables 43 to form three wire "pigtails." Solder is applied to these pigtails in the area indicated at "S" in FIG. 3. In some instances, a layer of heat-shrink tubing (not shown) may be applied over the solder junction at S to protect and insulate the joint so formed.

Not only is this known manner of ground termination labor-intensive, but it also carries a high degree of risk in damaging the performance characteristics of the interconnect cable 20. For example, care must be taken while soldering to prevent the soldering iron from contacting the inner dielectric layers 49 of the internal coaxial wires 43. If the dielectric layers 49 are touched by the soldering iron, they may melt and adversely affect the signal-carrying characteristics of the wires 43. Likewise, if the metal shielding braids 58 of the internal coaxial wires 43 and jumper wires 60 are crimped together, the likelihood exists that the integrity of the dielectric layer 49 may be compromised during crimping.

The present invention is directed to a grounding bridge which overcomes the above-mentioned problems and disadvantages experienced in terminating ground connections in interconnect cables and eliminates the need for unraveling the metal strands with the cable and coaxial cable shielding layers to effect such terminations.

Figure 4:
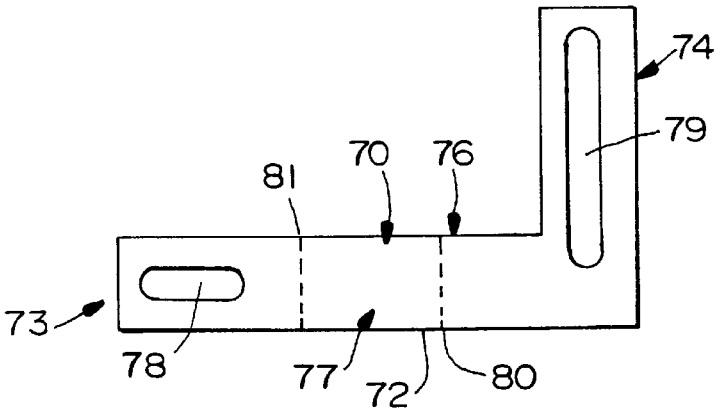
FIG. 4 is a plan view of a grounding bridge constructed in accordance with the principles of the present invention and useful in terminating cables such as that shown in FIG. 1.
Figure 5:
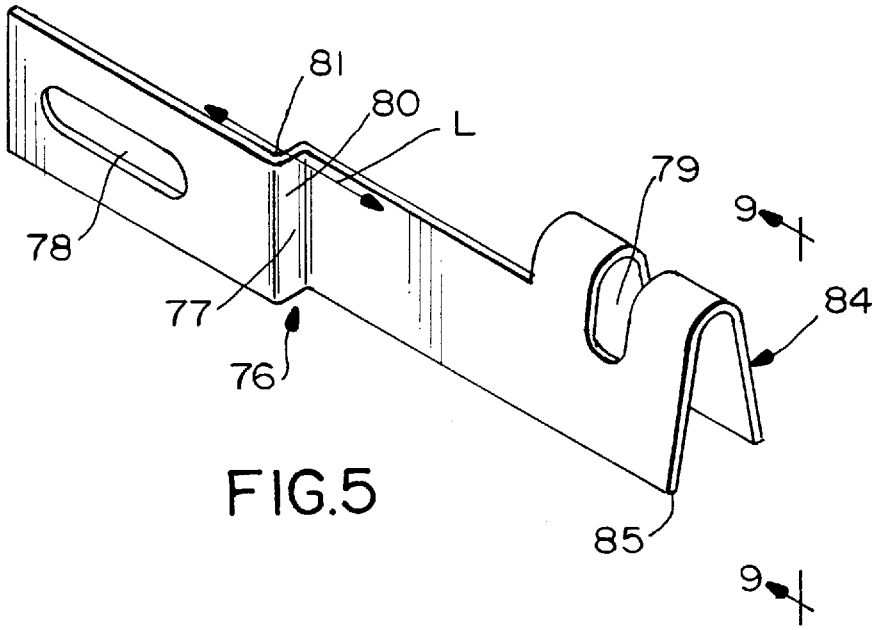
FIG. 5 is a perspective view of the grounding bridge of FIG. 4, illustrating how it is formed into a configuration suitable for application to an interconnect cable and the partial enclosure formed therein.

A grounding bridge constructed in accordance with the principles of the present invention is illustrated generally at 70 in FIGS. 4 & 5. The grounding bridge 70 is preferably stamped and formed from a sheet of metal, and it is preferred to use highly conductive easily-soldered metals, such as copper with an appropriate plating material. The grounding bridge 70 may first comprise a flat metal blank 72 having two legs, or arm portions 73, 74, which are spaced apart from and extend away from each other as illustrated. The two leg portions 73, 74 are joined together at an angle as shown and are interconnected by an intermediate portion 76. A part of the intermediate portion 76 is bent upon itself as explained below. This bent portion 77 defines a "step" 77 or "offset" in the completed grounding bridge 70.

During stamping, two access openings 78, 79 are formed in the grounding bridge blank 72 within the two leg portions 73, 74 thereof. As explained below, these solder-receiving openings provide entryways, or windows, through the leg portions of the bridge 70 to the underlying shielding in order to facilitate the termination process. After stamping, the bridge 70 is formed by bending the intermediate portion 76 near the first leg 73 (shown horizontal in FIG. 4) along two fold lines 80, 81 to in effect, create the offset 77 which assists in spacing the two leg portions 73, 74 their desired distance apart. This offset 77 extends generally transversely to the plane of the first leg portion 73 and need not be perpendicular so long as the first leg portion 73 and its contact surface 75 thereof will lie against the braiding of the cable metal shielding 45 in application, and the braiding thereof is exposed through the opening 78 associated with the first leg portion 73.

Figure 9:
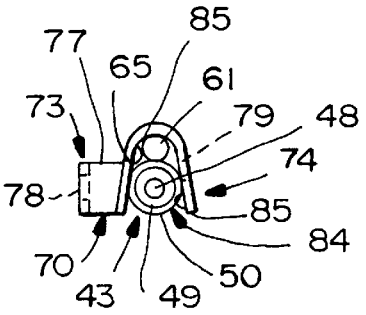
FIG. 9 is an end view of the grounding bridge of FIG. 5, looking from the end thereof as generally indicated by lines 9—9 thereof, illustrating how the jumper wire and coaxial wire are held within a leg portion of the grounding bridge; and, FIG. 10 is an end view of the grounding bridge of FIG. 6, looking from the end thereof as generally indicated by lines 10—10 thereof, illustrating how the jumper wire and coaxial wire are held within a leg portion of the grounding bridge.

The other, second leg portion 74 extends away from the first leg portion 73 (vertically as shown in FIG. 4) and has an extent sufficiently long to permit the leg portion 74 to be folded upon itself in order to define a generally U-shaped wire "nest" or "enclosure" 84 between opposing portions of the leg portion 74. As seen in FIG. 9, this enclosure 84 is hollow and partially encloses the internal coaxial cable 43 and its associated jumper wire conductor 61. The offset 77 serves to space the second leg portion enclosure 84 away from the first leg portion 73 so that the longitudinal axis of the internal coaxial cable 43 to which the grounding bridge 70 is applied remains generally in line with the longitudinal axis of the interconnect cable 21 at that immediate portion of the cable 21. This spacing is dictated by the width of the offset 77 which preferably is chosen so that the first leg portion 73 and its contact surface 75 will lie substantially flat against and contact the exposed metal shielding 45 of the cable 21. Specifically, the interior surface 85 of the enclosure 84 acts as a contact surface which contacts the jumper wire conductor 61 and the surface of the internal coaxial cable metal shielding 50. The contact surfaces 75 and 85 of the two leg portions 73, 74 lie on the same side of the grounding bridge blank 72.

Figure 6:
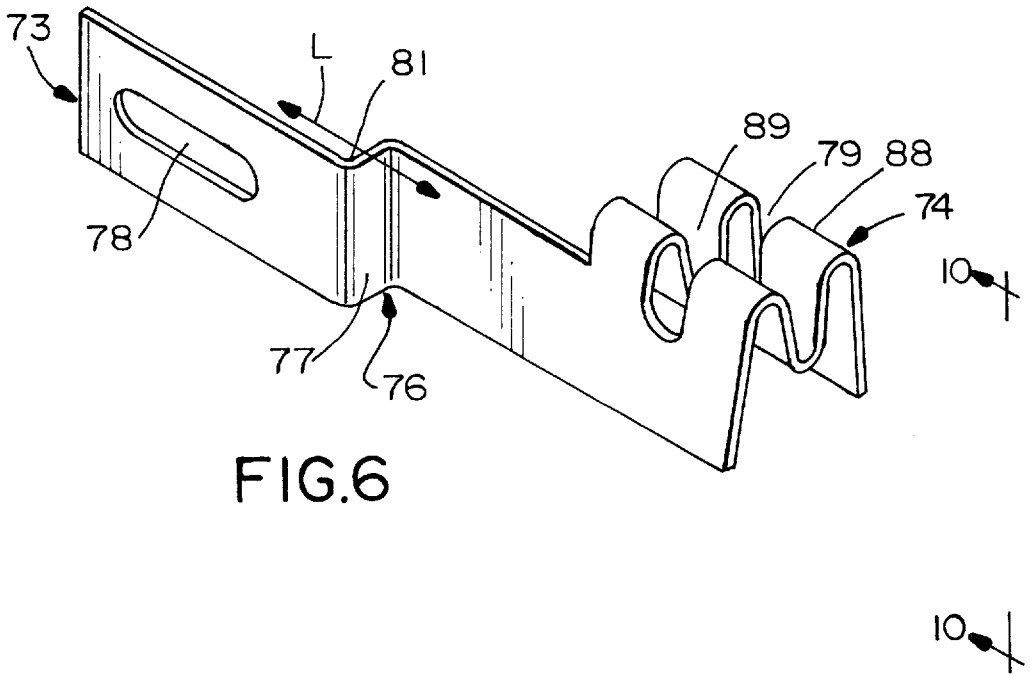
FIG. 6 is a perspective view of the grounding bridge of FIG. 4 as formed into an alternate application configuration.
Figure 10:
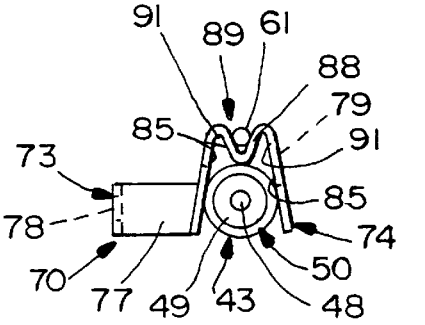

This partial enclosure 84 may take different forms. As illustrated in FIGS. 5 and 9, it may take a general U-or arch shape. As illustrated in FIG. 6, it may also include an interior accordion-style fold 88 which forms a central cradle, or support 89, into which the central conductor 61 of the jumper wire 62 may be positioned. (FIG. 10) Similarly, the jumper wire conductor 61 may also be positioned within either of the inner notches 91 formed by the leg portion 74 when it is folded upon itself. These notches 91 are part of the enclosure 84 and as seen in FIGS. 6 and 10, flank the cradle 89.

The grounding bridge 70 greatly simplifies the termination of ground connections to interconnect cables by eliminating the manual steps of manipulating the metallic braids of the various cables such as combining braids of the cable shielding, braids of the internal conductor shielding and the jumper wire together. Most advantageously, the present invention eliminates the need to unravel the metal shielding 45, 50 of the interconnect cable 21 and its internal coaxial wires 43, thus greatly reducing the time for terminating the ground paths of the cable 21 which results in an increase in the efficiency at which interconnect cables 20 may be terminated. The grounding bridge of the present invention also reduces the likelihood of heat damage to the dielectric layers 49 of the internal wires 43 of the cable 21 by providing a platform which supports a soldering iron during assembly as explained below.

Figure 7:
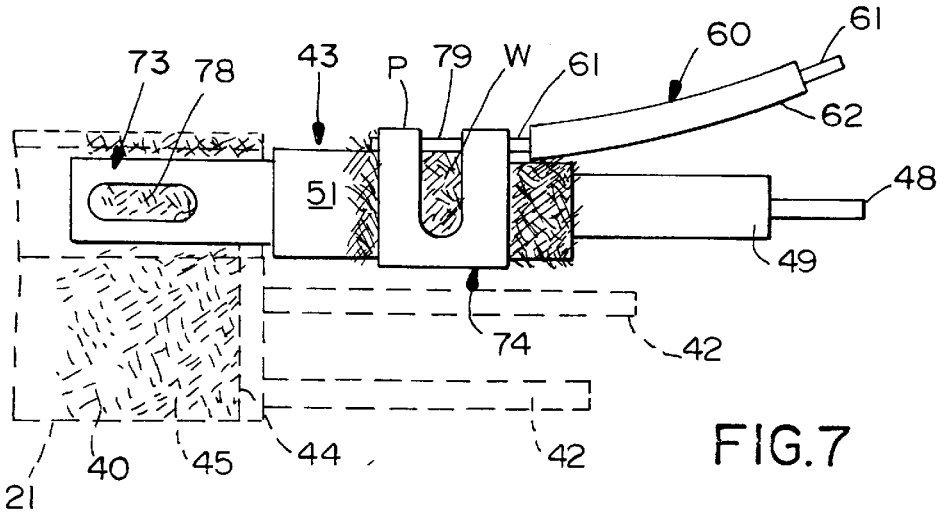
FIG. 7 is an enlarged view of the end of the cable of FIG. 1, illustrating the grounding bridge of the present invention as applied to an end of one of the cable internal coaxial wires, with the cable, its braiding and some of its internal wires being show in phantom for clarity.

In the termination of interconnect cables using the present invention, as illustrated in FIG. 7, a length of the outer insulation 51 of the respective internal coaxial cables 43 and a length of the outer insulation 40 of the cable 21 are removed to expose the metallic braid 50 of the internal coaxial cables 43 and the metallic braid 45 of cable 21. One grounding bridge 70 is applied to one of the three internal coaxial cables 43 so that its folded leg portion 74, and particularly, the enclosure 84 thereof partially envelops the metal braiding 50 of the coaxial cable 43 which has been exposed by removing a length its outer insulation layer 51. The contact surface 85 of the folded leg portion 74 then lies against the metal braiding 50 of internal coaxial cable 43. A jumper wire 60 may then be inserted into the interior of the enclosure 84 as shown in FIG. 9, either generally within the enclosure 84 or within the notches 91 thereof or positioned in the central cradle 89 thereof, as shown in FIG. 10 so that the jumper wire conductor 61 contacts the second leg portion 74.

A soldering iron (not shown) may then be applied to any of the outer surfaces of the second leg portion 74 surrounding the solder-receiving opening 79 associated therewith as represented by P in FIG. 7. Solder may then be applied in the opening as represented by W in FIG. 7 and, as the heat from the soldering iron melts the solder, it will flow into the opening 79 onto the metal braiding 50 and the jumper wire conductor 61 to thereby create a soldered joint between the three components: the jumper wire conductor 61, the metal braiding 50 of the internal coaxial cable 43 and the grounding bridge second leg portion 74. Thus, the solder-receiving openings 78, 79 of the leg portions 73, 74 are seen to act as soldering "windows" in this assembly.

Next, the first leg portion 73 of the soldering bridge 70 is positioned to contact the exposed metal shielding 45 of the cable 21. When so positioned, the grounding bridge first leg portion 73, its contact surface 75 and its associated solder-receiving opening 78 abut the exterior surfaces of the cable shielding 45. A soldering iron is then applied to surface P adjacent the opening 78 of the first leg portion 73. As first leg portion 73 heats up, it will also heat the underlying braiding of the metal shielding 45, and solder is applied through the first leg opening W in the manner described above to thereby effect a joint between the grounding bridge 70 and the cable shielding 45. In FIG. 7, the cable body 21, its metal shielding 45 and some of the internal wires 42 are shown in phantom so that the viewer is looking through the cable 21 onto the grounding bridge 70 and a portion of the coaxial wire 43 which extends out of the cable 21.

Figure 8:
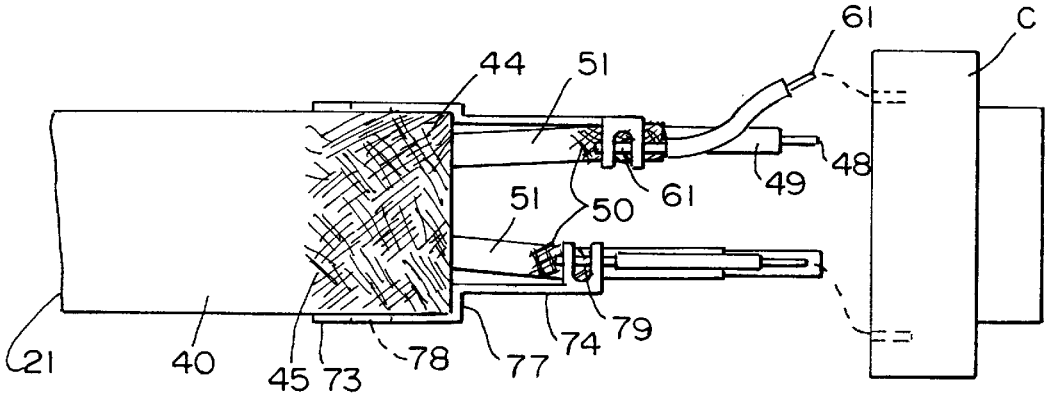
FIG. 8 is an end view of two grounding bridges of the present invention applied to two internal coaxial conductors and the interconnect cable, with the remaining internal wires of the cable removed for clarity.

This process is then repeated for another of the internal coaxial cables 43, to which a second grounding bridge is applied thereby resulting in a structure such as that illustrated in FIG. 8 which shows two coaxial cable ground connections effected. The process is repeated again using a third grounding bridge to connect the remaining internal coaxial cable to the cable shielding 45. It is being understood that this third connection will occur such that the interconnections at the ground shield 45 of cable 21 are approximately 120° apart.

The individual conductors 46, 48 and 61 of the various wires 42, 43 and 60, respectively are then terminated to appropriate contacts or terminals such as the female terminals 34 shown in FIG. 1. These terminated terminals are then inserted into the connector housing "C" shown in FIG. 8 as is known in the art.

It will be appreciated that the embodiments of the present invention which have been discussed are merely illustrative of some of the applications of this invention and that numerous modifications may be made by those skilled in the art without departing from the true spirit and scope of this invention.

We claim:

1. A grounding bridge for establishing a groundpath in a shielded interconnect cable, wherein the cable includes a central core, a first conductive outer shielding layer extending coaxially along the central core, the central core containing a plurality of wires, at least one of the central core wires being a coaxial cable with a central conductor surrounded by a dielectric layer, the inner dielectric layer being surrounded by a second conductive inner shielding layer, the grounding bridge comprising:

an elongated conductive metal member having first and second leg portions, the first leg portion extending lengthwise in one direction along an axis of said conductive metal member, said first leg portion including a contact surface disposed thereon, said contact surface adapted for positioning on and soldering to said first conductive outer shielding layer of said cable, an intermediate portion extending generally along said axis between said first and second leg portions, the second leg portion extending at least partly generally transversely to said first leg portion and said axis, said second leg portion defining a partial cable enclosure for receiving said central core coaxial cable and a conductor of a jumper wire therein, said second leg portion including a second leg portion contact surface for positioning in contact with said second conductive inner shielding layer, said partial cable enclosure being dimensioned to receive both said coaxial cable with a portion of said second conductive shielding layer exposed and a conductor of a jumper wire therein, the second leg portion contact surface being adapted for soldering to the second conductive inner shielding layer and the conductor of the jumper wire, and said grounding bridge providing a conductive path between said first and second conductive shielding layers and said jumper wire when said first and second leg portions are respectively soldered to said first and second conductive inner and outer shielding layers.

2. The grounding bridge as defined in claim 1, wherein said partial enclosure is formed by bending said second leg portion upon itself.

3. The grounding bridge as defined in claim 1, wherein said second leg portion includes a second access opening disposed therein which communicates with said partial enclosure, whereby the second access opening exposes part of said second conductive inner shielding layer through said second leg portion to permit passage of molten solder through said second access opening when said second leg portion partial enclosure is applied to said central core coaxial cable.

4. The grounding bridge as defined in claim 3, wherein said first leg portion includes a first access opening disposed therein, whereby the first access opening exposes part of said first conductive outer shielding layer through said first leg portion to permit passage of molten solder through said first access opening when said grounding bridge is applied to said cable and said first leg portion contact surface is positioned over and contacted with said first conductive shielding layer.

5. The grounding bridge as defined in claim 3, wherein said partial enclosure includes a wire-receiving cradle which receives the jumper wire conductor therein, the wire-receiving cradle extending generally parallel to said first leg portion and further communicating with said access opening.

6. The grounding bridge as defined in claim 5, wherein said second leg portion includes an accordion-style fold which defines part of said partial enclosure.

7. The grounding bridge as defined in claim 6, wherein said accordion-style fold defines said jumper wire-receiving cradle.

8. The grounding bridge as defined in claim 7, wherein said jumper wire-receiving cradle is disposed in the center of said accordion-style fold.

9. The grounding bridge as defined in claim 1, wherein said partial enclosure extends along part of said intermediate portion.

10. The grounding bridge as defined in claim 1, wherein said intermediate portion further offsets said first and second leg portions from each other.

11. The grounding bridge as defined in claim 1, wherein said partial enclosure has a general arch-like cross-sectional configuration.

12. The grounding bridge as defined in claim 1, wherein said partial enclosure has a general U-shape cross-sectional configuration.

13. The grounding bridge as defined in claim 1, wherein each said second leg portion contact surface is disposed on the interior of said partial enclosure.

14. The grounding bridge as defined in claim 1, wherein said intermediate portion is offset from said first leg portion.

15. The grounding bridge as defined in claim 1, further comprising a transition section between said intermediate portion and said first leg portion.

16. The grounding bridge as defined in claim 1, wherein said first leg portion is generally planar and said second leg portion is generally U-shaped.

* * * * *